US005974781A

United States Patent [19]

Correa et al.

[11] Patent Number: 5,974,781

[45] Date of Patent: Nov. 2, 1999

[54] HYBRID CAN-ANNULAR COMBUSTOR FOR AXIAL STAGING IN LOW NOX COMBUSTORS

[75] Inventors: Sanjay Marc Correa, Niskayuna; Jeffery Allan Lovett, Scotia, both of N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/947,452

[22] Filed: Oct. 6, 1997

Related U.S. Application Data

[63] Continuation of application No. 08/578,761, Dec. 26, 1995, abandoned.

[51] Int. Cl.[6] ..... F02C 3/00

[52] U.S. Cl. ..... 60/39.37; 60/737; 60/747

[58] Field of Search ..... 60/39.37, 737, 60/746, 747, 748

[56] References Cited

U.S. PATENT DOCUMENTS

| | | | |
|---|---|---|---|
| 4,253,301 | 3/1981 | Vogt | 60/746 |
| 5,285,635 | 2/1994 | Savelli et al. | 60/747 |
| 5,402,634 | 4/1995 | Marshall | 60/747 |
| 5,465,570 | 11/1995 | Szillat et al. | 60/747 |

*Primary Examiner*—Charles G. Feay
*Attorney, Agent, or Firm*—Patrick K. Patnode; Marvin Snyder

[57] ABSTRACT

The instant invention is directed in general to combustors for gas turbines and, more specifically, to a hybrid can-annular combustor for axial staging in low NOx Combustion. In a preferred embodiment, the instant invention uses premixing stages at different axial positions to carry out axial staging of the heat release for increased operability, where the combustor has a first premixing means for injecting a fuel-air mixture into a can-type configuration for providing the advantages of a can-type combustor for low-load and/or low-temperature conditions and a second premixing means for injecting a fuel-air mixture into an annular-type configuration for providing the advantages of an annular-type combustor for high load and/or high temperature conditions.

1 Claim, 4 Drawing Sheets

HYBRID CAN-ANNULAR COMBUSTOR FOR AXIAL STAGING IN LOW NOX COMBUSTORS

CROSS-REFERENCE RELATED TO APPLICATIONS

This application is a Continuation of application Ser. No. 08/578,761 filed Dec. 26,1995, now abandoned.

BACKGROUND OF THE INVENTION

The instant invention is directed in general to combustors for gas turbines and, more specifically, to a hybrid can-annular combustor for axial staging in low NOx Combustion.

Over the past ten years there has been a dramatic increase in the regulatory requirements for low emissions from gas turbine power plants. Environmental agencies throughout the world are now requiring even lower rates of emissions of NOx and other pollutants from both new and existing gas turbines.

Traditional gas turbine combustors use nonpremixed diffusion flames in which fuel and air freely enter the combustion chamber separately. Typical diffusion flames are dominated by regions which burn at or near stoichiometric conditions. The resulting flame temperatures can exceed 3000° F. Because diatomic nitrogen rapidly disassociates at temperatures exceeding about 3000° F., diffusion flames typically produce unacceptably high levels of NOx emissions.

One method commonly used to reduce peak temperatures, and thereby reduce NOx emissions, is to inject water or steam into the combustor. However, water/steam injection is a relatively expensive technique and can cause the undesirable side effect of quenching carbon monoxide (CO) burnout reactions. Additionally, water/steam injection methods are limited in their ability to reach the extremely low levels of pollutants required in many localities. More frequent combustion inspections and decreased hardware life are additional side effects that can result from the use of water/steam injection methods to reduce NOx emissions from combustion turbines.

Lean premixed combustion is a much more attractive method of lowering peak flame temperatures, and correspondingly, NOx emission levels. In lean premixed combustion, fuel and air are premixed in a pre-mixing section, and the fuel-air mixture is injected into a combustion chamber where it is burned. Due to the lean stoichiometry resulting from the premixing, lower flame temperatures and NOx emission levels are achieved.

Several types of low NOx emission combustors are currently employing lean-premixed combustion for gas turbines, including can and annular type combustors.

Can combustors typically consist of a cylindrical can-type liner inserted into a transition piece with multiple fuel-air premixers positioned at the head end of the liner. Such an arrangement is illustrated in FIG. 1. Although this system is practical and easy to assemble, it has several inherent disadvantages for achieving ultra-low emissions and maximum operability.

Can combustors are relatively lengthy and provide a long combustor residence time. During low load and/or low temperature operation, the levels of carbon monoxide (CO) and unburned hydrocarbon are minimized due to the long combustor residence time.

However, during high load and/or high temperature operation, diatomic nitrogen begins to rapidly disassociate, and NOx emissions grow in time. Therefore, the large residence time of the can combustor results in high NOx emissions during high-load and/or high temperature operation.

Annular combustors are also used in many gas turbine applications. Annular combustors typically consist of multiple premixers positioned in rings directly upstream of the turbine nozzles in an annular fashion. Such an arrangement is illustrated in FIG. 2. The annular combustor is short in length and accordingly, has a relatively short combustor residence time.

During high load and/or high temperature operation, the levels of NOx emissions are low due to the short combustor residence time in the short annular combustor.

However, during low load and/or low temperature operation, the levels of carbon monoxide (CO) and unburned hydrocarbon (UHC) are large due to the short combustor residence time of the annular combustor, not allowing complete CO and UHC burnout.

Additionally, combustion instability poses serious limitations upon the operability of premixed combustion systems. The strength of such instabilities can be substantially reduced by spreading the combustion out within the combustor such that the process is not concentrated in one location. Accordingly, significant improvements in operability can be accomplished if the combustion is distributed along the axis of the combustor. This distribution is termed axial staging.

Therefore, it is apparent from the above that there exists a need in the art for a combustor which uses premixing stages at different axial positions to carry out axial staging of the heat release for increased operability, where the combustor has a first premixing means for injecting a fuel-air mixture into a can-type configuration for providing the advantages of a can type combustor for low load and/or low temperature conditions and a second premixing means for injecting a fuel air mixture into an annular type configuration for providing the advantages of an annular type combustor for high load and/or high temperature conditions. It is a purpose of this invention, to fulfill these and other needs in the art in a manner more apparent to the skilled artisan once given the following disclosure.

SUMMARY OF THE INVENTION

The above-mentioned needs are met by the instant invention which provides a novel combustor which uses premixing stages at different axial positions to carry out axial staging of the heat release for increased operability.

In a preferred embodiment of the instant invention, a cylindrical combustor casing is provided with a combustion liner disposed within said outer combustor casing, defining a combustion chamber having an upstream end and a downstream end, a first premixing means in fluid communication with the upstream end of said combustion chamber, a second premixing means positioned adjacent to the combustion chamber and a transition piece affixed to said combustion liner. During low load or low temperature operation, the first premixing means injects a fuel-air mixture into the combustion chamber to be combusted and the second premixing means injects air into the transition piece. During high load or high temperature operation, the first premixing means continues to inject a fuel-air mixture into the combustion chamber to be combusted and the second premixing means injects a fuel-air mixture into the transition piece to be combusted.

Within the instant invention, emissions are minimized due to the novel staging scheme. During low load or low temperature operation, the fuel-air mixture is injected into the combustion chamber by the first premixing means, where it is ignited and combusted within the combustion chamber, and the combustion products flow through the transition piece and out to the turbine inlet. This portion simulates a can type combustor and takes advantage of the long residence time to decrease CO and UHC emissions. NOx emissions remain low during low load or low temperature operation because the temperature is not high enough to cause diatomic nitrogen to disassociate. During high load or high temperature operation, the fuel-air mixture is injected into both the combustion chamber, by the first premixing means, and directly into the transition piece by the second premixing means. The fuel-air mixture injected into the combustion chamber is combusted within the combustion chamber and the combustion products flow thorough the transition piece and out to the turbine inlet just as in the low load and/or low temperature operation. The fuel/air mixture injected into the transition piece ignites and is combusted within the transition piece. This portion of the combustor simulates an annular type combustor and takes advantage of the short residence time to decrease NOx emission. The CO and UHC levels are low during high temperature and/or high load operation because the high temperatures burn off the CO and UHC emissions very quickly.

This hybrid type of can-annular combustor results in lower overall emissions during all phases of operation and across the load range. Additionally, the use of axial staging distributes the heat release throughout the combustor, thereby resulting in significant improvement in operability.

Other objects and advantages of the present invention will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
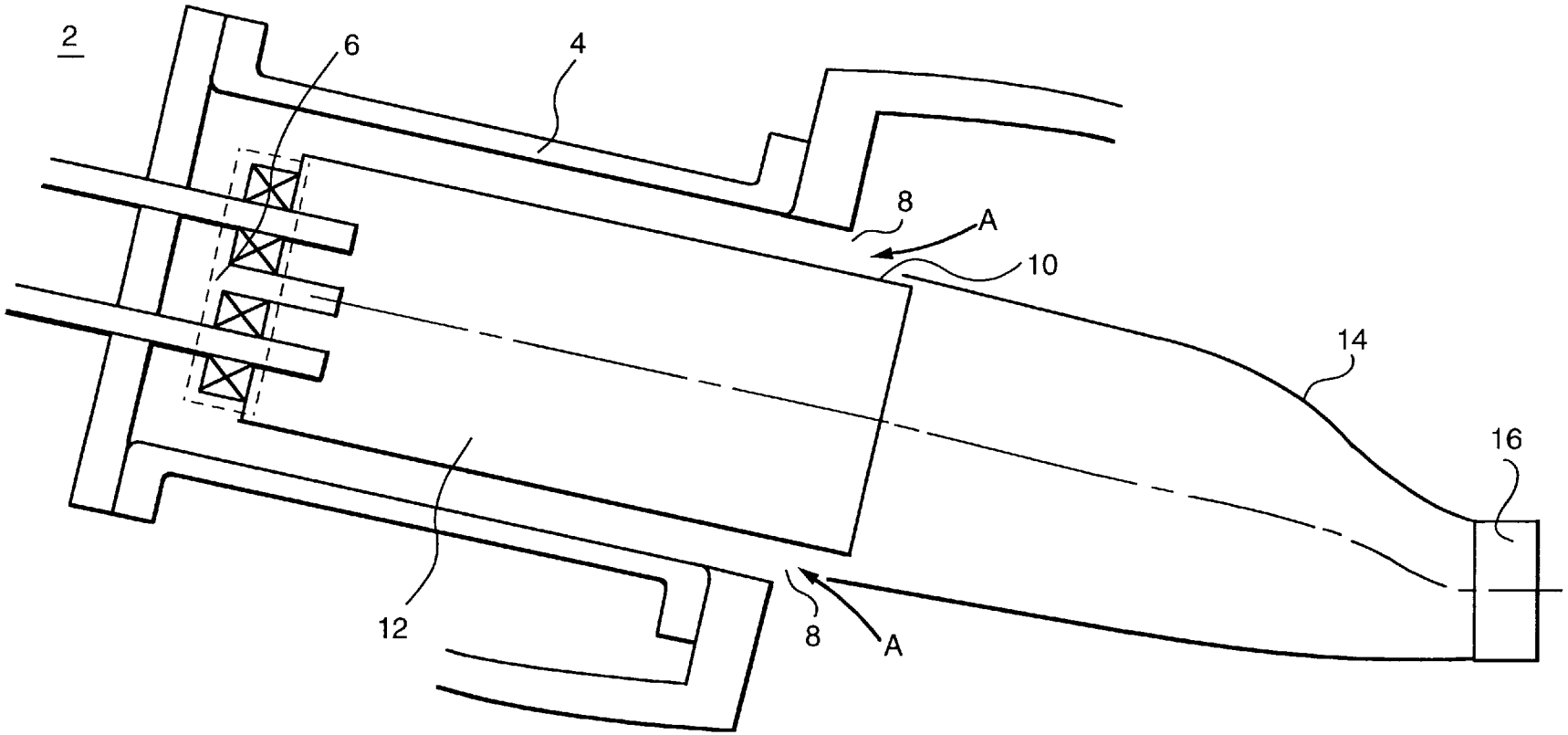
FIG. 1 shows a cross-sectional side view of a conventional can type combustor.

As discussed earlier, FIG. 1 illustrates a conventional can combustor 2. Can combustor 2 includes, casing 4, premixing means 6, air inlet(s) 8, can liner 10, combustion chamber 12, transition piece 14, and nozzle 16.

During the operation of conventional can combustor 2, combustion air enters in through air inlet(s) 8 along the direction of arrows A and enters into casing 4. Combustion air then enters premixing means 6 where it is mixed with fuel. The fuel-air mixture is then injected by premixing means 6 into combustion chamber 12 where it is combusted. After the fuel-air mixture is combusted it is exhausted through transition piece 14 and nozzle 16. As mentioned, one down side of the can combustor is its length. The combustion products flow from the upstream end of the combustion chamber through the entire chamber and enter into the transition piece until exiting through the nozzle. This results in a long combustor residence time and accordingly, during high temperature and/or high load operation, high levels of NOx emissions. However, the can-annular combustor works well during low temperature and/or low load operation, as the long combustor residence time allows the CO and UHC to burn off during this long period, resulting in low CO and UHC emission levels.

Figure 2:
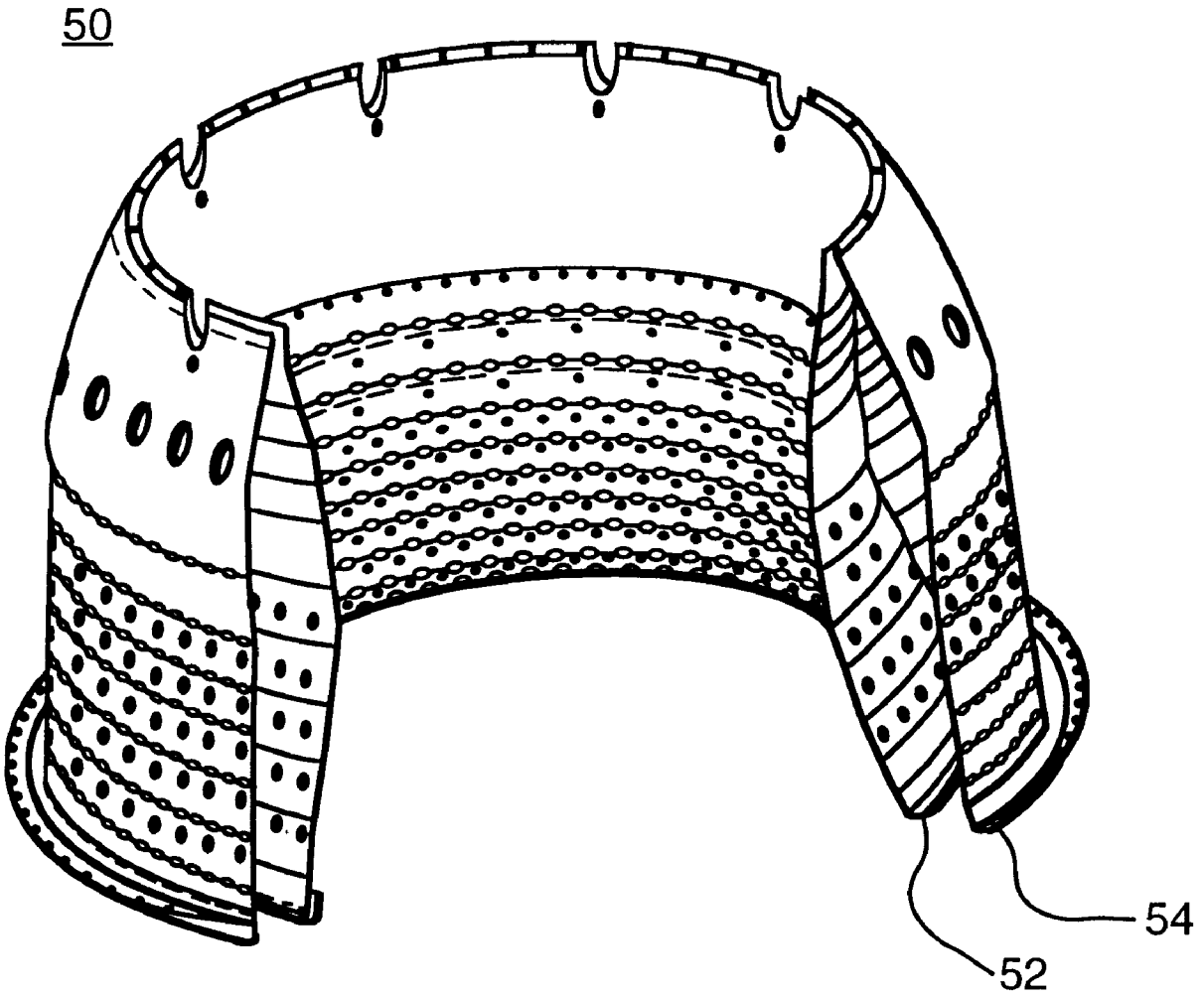
FIG. 2 shows a cross-sectional side view of a conventional annular type combustor.

FIG. 2 depicts an annular type combustor 50. A typical annular combustor 50 consists of a single flame tube, completely annular in form, which is contained in continuous, circular inner 52 and outer combustion casings 54 or skirts, without any separate interior burner cans. This construction provides the most effective mixing of fuel and air, and due to optimum burner surface area, maximum cooling of the combustion gases takes place. Due to its annular shape, the annular combustor has no need for a transition piece, making it much more compact then a can type combustor. As discussed earlier, one down side of the annular combustor is this short length. The combustor residence time is low, and accordingly, during low temperature and/or low load operation, high levels of CO and UHC emissions are present. However, the annular combustor works well during high temperature or high load operation, as the short combustor residence time does not give the NOx emissions sufficient growth time, resulting in low levels of NOx emissions.

Figure 3:
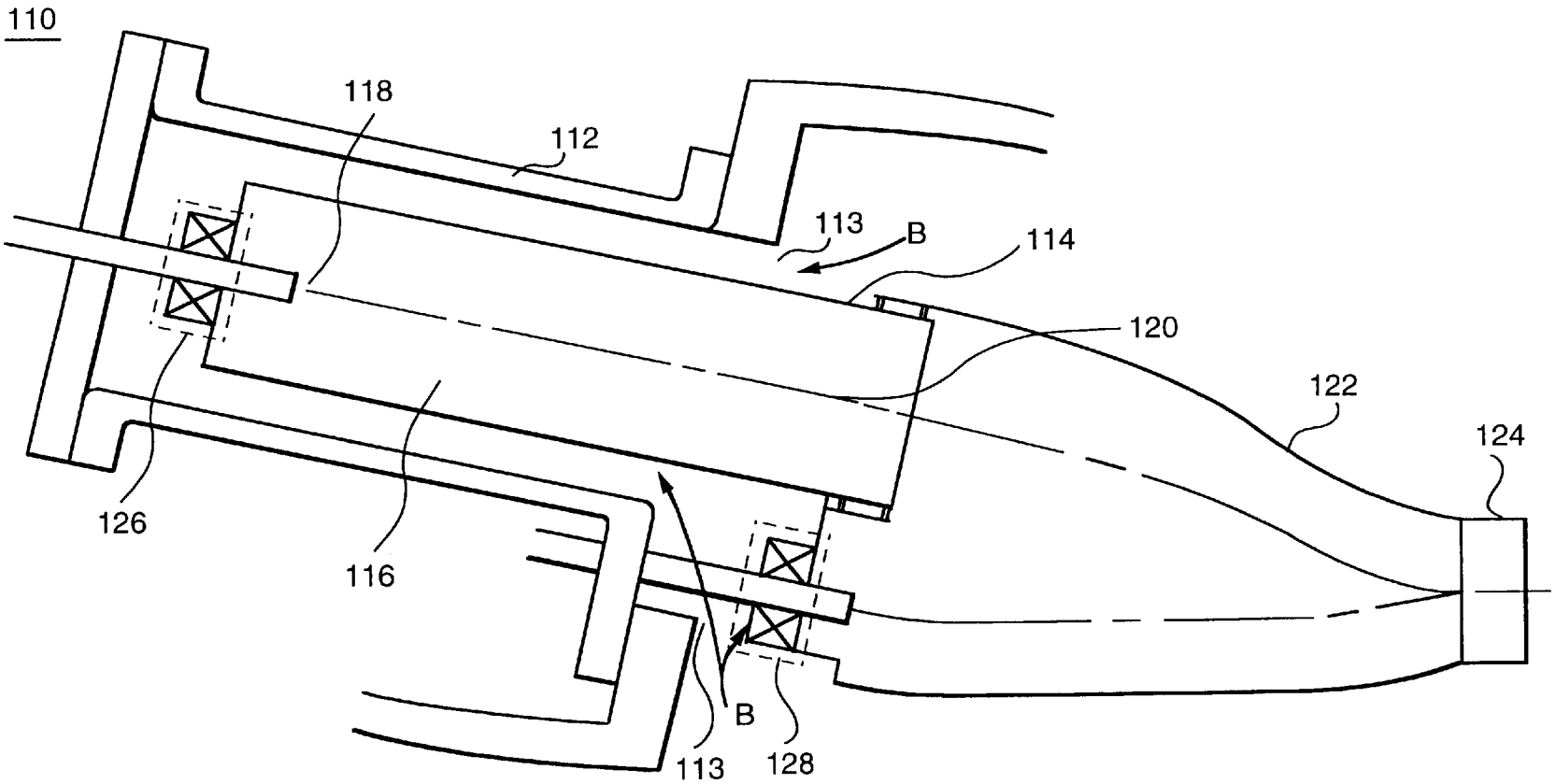
FIG. 3 shows a cross-sectional side view of a hybrid can-annular combustor of the instant invention.

Now referring to FIG. 3, a novel combustor 110 is depicted. Combustor 110 cooperates with a compressor means (not shown) in driving a gas turbine means (not shown). Combustor 110 comprises a cylindrical outer combustor casing 112 which has one or more air inlet(s) 113 for supplying air to the combustor 110. Disposed within said outer combustor casing 112 is a combustion liner 114, which defines a combustion chamber 116 therein. Combustion chamber 116 has an upstream end 118 and a downstream end 120. The flow of combustion products exiting the downstream end 120 of combustion chamber 116 enters a transition piece 122, fixedly attached to said combustion liner 114. Transition piece 122 is used to transition the circular cross-section of the combustion liner 114, through nozzle 124, to a sector portion of a turbine inlet (not shown), so as to allow the flow of combustion products to enter a turbine, allowing the turbine to harness the energy of the combustion products to drive said turbine. In a preferred embodiment, the length of combustion liner 116 should be long enough to allow sufficient CO burnout in low load or low temperature operation before the combustion products exit into transition piece 122.

A first premixing means 126 is positioned at the upstream end 118 of said combustion chamber 116, for injecting a fuel-air mixture into said combustion chamber 116. In a preferred embodiment, said first premixing means 126 comprises a fuel injector, often using fuel spokes, for injecting fuel into combustion chamber 116 and one or more swirl vanes for mixing the fuel with combustion air prior to injection into combustion chamber 116. During operation, combustion air enters through inlet(s) 113 along the direction of arrow B and enters into casing 112. The combustion air enters first premixing means 126 and is mixed with fuel. The fuel-air mixture is then injected by first premixing means 126 into combustion chamber 116. As the fuel-air mixture enters combustion chamber 118, it is combusted.

A second premixing means 128 is positioned adjacent said combustion liner 114 and is in fluid communication with said transition piece 122, for injecting a fuel-air mixture into said transition piece 122. In a preferred embodiment, said second premixing means 128 comprises a fuel injector, often using fuel spokes, for injecting fuel into transition piece 122 and one or more swirl vanes for mixing the fuel with combustion air prior to injection into the transition piece 122. During operation, combustion air enters through inlet (s) 113 along the direction of arrow B and enters into casing 112. The combustion air then enters second premixing means 128 and is mixed with fuel. The fuel-air mixture is then injected by second premixing means 128 into transition piece 122. As the fuel-air mixture enters transition piece 122, it is combusted. In a preferred embodiment, said second premixing means 128 is affixed to a pressure bulkhead 109 to support the axial staging within the combustor.

In certain preferred embodiments, combustor 110 may further include a means of igniting a mixture of fuel and air 131 within said combustion chamber 116 and within said transition piece 122.

Figure 4:
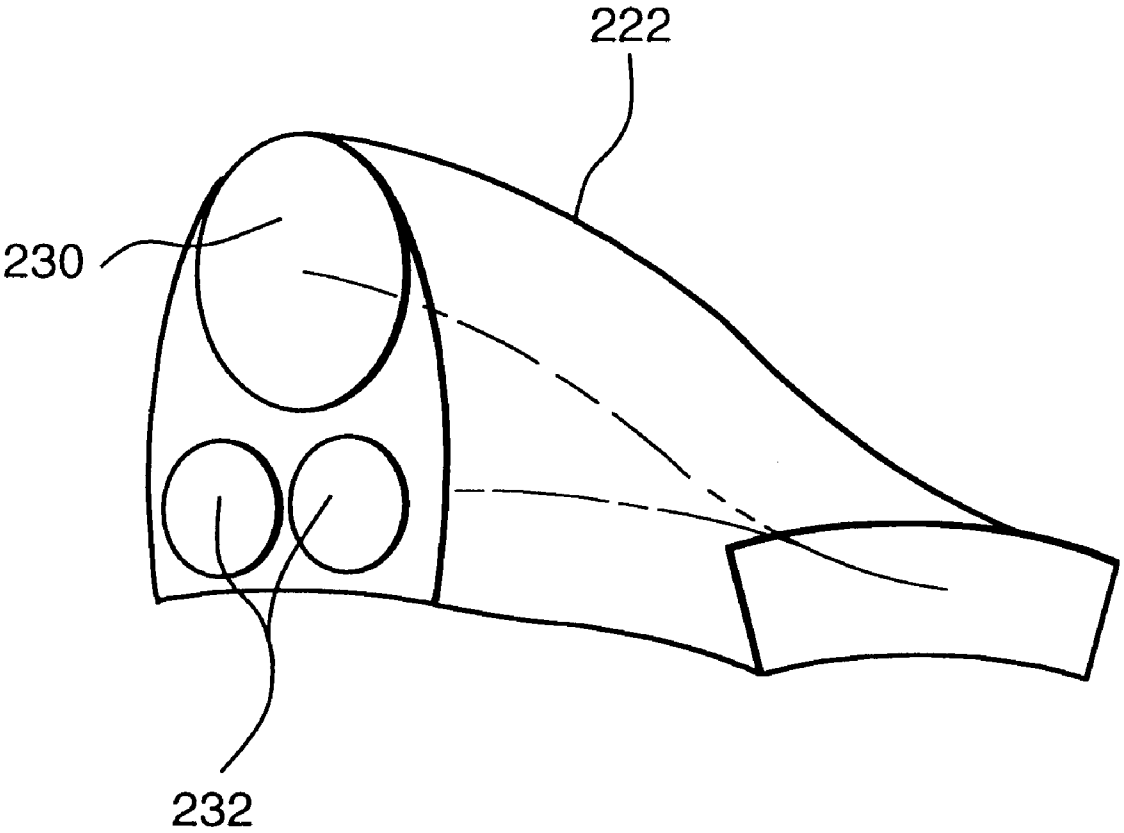
FIG. 4 shows a cross-sectional side view of a preferred embodiment of the transition piece of the instant invention.

Referring to FIG. 4, a preferred embodiment of transition piece 222 is shown having a first port 230, which is aligned with the combustion chamber and one or more second port(s) 232, which are aligned with the second premixing means. In operation, combustion products from the combustion chamber would exit through first port 230 and to the turbine inlet and second port(s) 232 would house the combustion of the fuel-air mixture injected from second premixing means and vent the resulting combustion products to the turbine inlet.

During low load operation, often less than 50% capacity, and/or low temperature operation, combustion air enters through inlet(s) 113 along the direction of arrow(s) B and enters into casing 112. The combustion air then enters first premixing means 126 and is mixed with fuel. The combustion air also enters second premixing means, however little or no fuel is mixed with the combustion air entering the second premixing means 132 during low load and/or low temperature operation. The fuel-air mixture is injected by first premixing means 126 into said combustion chamber 118, the fuel-air mixture is burned and the combustion products flow through transition piece 122, out of nozzle 124, and into the turbine inlet. CO burnout within the combustion chamber 118 should be complete by the time the combustion products exit into transition piece 122, therefore, the combustion air entering the transition piece from the second premixing means 128 will not cause high CO concentrations due to "CO-quenching." Low load and/or low temperature operation within the instant invention will produce low levels of CO and UHC because of the long combustion residence time, allowing CO and UHC to be burned off, and low levels of NOx because the temperature levels are not high enough to cause rapid disassociation of diatomic nitrogen.

During high load operation, often greater than 50% capacity, and/or high temperature operation, combustion air enters through inlet(s) 113 along the direction of arrow(s) B and enters into casing 112. The combustion air continues to enter first premixing means 126, just as in low load and/or low temperature operation, where it is mixed with fuel. The combustion air enters second premixing means 126 where it is also mixed with fuel. The fuel-air mixture from first premixing means 126 continues to be injected into combustion chamber 118, where the fuel-air mixture is burned and the combustion products flow through the transition piece 122 and to the turbine inlet. However, during high load and/or high temperature operation, a fuel-air mixture is also injected into the transition piece 122 by second premixing means 128, where the fuel-air mixture is burned and the combustion products flow thorough transition piece 122 and into the turbine inlet.

In a preferred embodiment, the fuel-air mixture entering the transition piece 122 from second premixing means 132 is ignited by the high heat of the combustion products traveling through the transition piece 122 from the combustion chamber 118. The high load and/or high temperature operation within the instant invention will continue to produce low levels of CO and UHC because the high temperatures will burn the emissions off faster compensating for the shorter combustor residence time of the transition piece 122, and low levels of NOx because the combustion residence time of the transition piece 122 is low.

By using the second premixing means only at high-load and/or high temperature operation, this hybrid combustor has several advantages. The residence time of the combustion products originating from the second premixing means is significantly lower than of those injected by the first premixing means, thereby contributing significantly to reduced NOx compared with an operation using only the first premixing means 126.

Additionally, because a can system requires reverse flow of cold air to cool its liner, the pressure drop associated with can combustors is significantly higher than for an annular type. Accordingly, in the instant hybrid design, a large portion of the combustion air passes only through the second premixing means 128 thereby reducing the overall pressure drop of the system compared with a can configuration. Furthermore, by using premixing stages at different axial positions to carry out axial staging of the heat release, the instant invention makes significant improvements in combustor operability. In addition, the total surface area of the hot-gas path is reduced within the instant invention thereby reducing the cooling requirements compared with a can configuration.

The foregoing has described several embodiments of a hybrid can-annular combustor for axial staging in low-NOx combustors. While specific embodiments of the instant invention have been described, it will be apparent to those skilled in the art that various modifications thereto can be made without departing from the spirit and scope of the invention as defined in the appended claims.

We claim:

1. An axial staged combustor comprising:

a combustion liner defining a combustion chamber having an upstream end and a downstream end;

a transition piece having a first port coupled to said downstream end of said combustion liner;

a first premixer disposed at said upstream end of said combustion liner; and a second premixer affixed to a pressure bulkhead positioned axially downstream from said first premixer, wherein said second premixer is directly coupled to at least a second port of said transition piece and is substantially isolated from said combustion chamber; wherein combustion air and fuel are mixed and burned in said first premixer during low load operation and combustion air and fuel are mixed and burned in each of said first and second premixes during high load operation.

* * * * *